US006872057B2

(12) United States Patent
Kim

(10) Patent No.: US 6,872,057 B2
(45) Date of Patent: Mar. 29, 2005

(54) HERMETIC COMPRESSOR CASING

(75) Inventor: Saeng-ho Kim, Incheon (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 143 days.

(21) Appl. No.: 10/369,917

(22) Filed: Feb. 20, 2003

(65) Prior Publication Data

US 2004/0052659 A1 Mar. 18, 2004

(30) Foreign Application Priority Data

Sep. 17, 2002 (KR) ..... 10-2002-0056570

(51) Int. Cl.[7] ..... F04B 39/12
(52) U.S. Cl. ..... 417/312; 181/202; 417/902
(58) Field of Search ..... 417/312, 423.14, 417/902; 181/200, 202, 403

(56) References Cited

U.S. PATENT DOCUMENTS 3,250,461 A * 5/1966 Parker ..... 417/312
3,857,652 A * 12/1974 Thayer ..... 417/312
4,347,042 A * 8/1982 Holdsworth ..... 181/202
4,347,043 A * 8/1982 Morris ..... 181/202
5,151,018 A * 9/1992 Clendenin et al. ..... 417/312
5,588,810 A * 12/1996 DiFlora et al. ..... 417/312
5,997,258 A * 12/1999 Sawyer et al. ..... 417/312

* cited by examiner

*Primary Examiner*—Michael Koczo, Jr.
(74) *Attorney, Agent, or Firm*—Ladas & Parry LLP

(57) ABSTRACT

A hermetic compressor casing is capable of reducing transmission of vibration to the outside environment by blocking the vibration from the compressor body. The hermetic compressor casing encloses a refrigerant compressing means, which draws in low temperature and low pressure gaseous refrigerant from an evaporator, compresses the drawn refrigerant and discharges the compressed refrigerant. The hermetic compressor casing includes an inner shell enclosing the refrigerant compressing means and having a passageway through which the gaseous refrigerant is drawn in and discharged out, a damping layer enclosing the exterior of the inner shell having a predetermined thickness, and an outer shell enclosing the exterior of the damping layer. As a result, vibration produced from the refrigerant compressing means is damped through the damping layer.

11 Claims, 6 Drawing Sheets

HERMETIC COMPRESSOR CASING

BACKGROUND OF THE INVENTION

1. Field of the Invention

The present invention relates generally to a hermetic compressor for use in a refrigerant cycle, and more particularly, to a casing of a hermetic compressor contributing to reduction of vibration and noise produced from the hermetic compressor.

2. Description of the Prior Art

Following a refrigerant cycle, a conventional hermetic compressor draws in low temperature and low pressure vapor refrigerant from an evaporator and compresses it into high temperature and high pressure vapor refrigerant, and then discharges the refrigerant to a condenser.

FIG. 1 shows the structure of such conventional hermetic compressor. Referring to FIG. 1, the hermetic compressor includes a motor, a cylinder, a casing 50 partitioning a compressor body 10 from the outside environment, and a supporting member 30 for supporting the compressor body 10. The compressor body 10 contains therein a suction/discharge pipe and draws in and compresses refrigerant.

The motor is comprised of a stator 12 secured on the supporting member 30 and a rotor 14 rotating inside of the stator 12. A rotary shaft 16 is mounted in and attached to the center of the rotor 14, and an eccentric portion 18 is formed at the lower end of the rotary shaft 16.

The cylinder includes a cylinder body 22 that defines a bore 23 for the refrigerant suction/compression, and a valve 26 disposed on the upper portion of the cylinder body 22 to control the refrigerant suction/discharge. A piston 24 is assembled in the cylinder body 22 to be reciprocally movable therein. The piston 24 is connected to a connecting rod 20 connected to the eccentric portion 18 that converts the rotary motion of the rotary shaft 16 into linear reciprocal motion.

The suction/discharge pipe 28 connects the valve 26 of the cylinder to the refrigerant cycle, and define a passageway through which refrigerant is drawn in and discharged out.

The supporting member 30 is disposed inside of a lower shell 54 of the casing 50 and supports the stator 12 and the cylinder body 22 of the motor, thereby partitioning the compressor body 10 off from the casing 50. The supporting member 30 is formed of a spring so as to absorb vibration produced during a rotation of the eccentric portion 18 and reciprocal movement of the piston 24.

The casing 50 encloses the compressor body 10 from outside, and is comprised of an upper shell 52 and the lower shell 54 for easy assembling. The supporting member 30 is disposed in the lower shell 54, and the compressor body 10 is mounted on the supporting body 30. The lower shell 54 has an aperture through which the suction/discharge pipe 28 extends. For simplicity of the fabricating process and strength of the casing 50, the upper and lower shells 52 and 54 of the casing 50 are made by molding of a metal plate. The upper and lower shells 52 and 54 are connected to each other, for example, by welding.

When the supply of electricity is provided to the hermetic compressor constructed as above, the rotor 14 starts rotating. With the rotation of the rotor 14, the rotary shaft 16, which is integrally attached to the rotor 14, also rotates. And, as the rotary shaft 16 rotates, the piston 24 starts reciprocating in the cylinder body 22 by motion of the eccentric portion 18 and the connecting rod 20 at the leading end of the rotary shaft 16. By reciprocating the piston 24 inside of the bore 23, the valve 26 is moved to permit the refrigerant to be drawn in through the suction/discharge pipe 28 for compression and to be discharged out to the refrigerant evaporator cycle. More specifically, as the piston 24 moves toward the lower dead end, the suction valve 29 opens, permitting the low temperature and low pressure gaseous refrigerant into the cylinder bore 23 via the suction pipe (not shown). Then as the piston 24 moves toward the upper dead end, the suction valve 29 closes, and the refrigerant in the bore 23 is compressed. After the compression of the refrigerant, the discharge valve 27 opens, permitting the compressed refrigerant to be discharged toward the condenser via the discharge pipe 28. During the rotation of the rotary shaft 16, the piston 24 keeps reciprocally moving up and down between the upper and lower dead ends, repeating the refrigerant cycle described above.

As described above, the rotor 14 rotates, and the rotary motion of the rotor 14 is converted to the reciprocal movement of the piston 24 by the eccentric portion 18 and the connecting rod 20 during the cycle of refrigerant suctioning, compressing and discharging in the compressor body 10. Accordingly, a considerable amount of vibration and noise is produced. The supporting member 30 is provided for absorbing, and thus reducing, the vibration and noise from the compressor body 10. However, the vibration and noise is not completely absorbed, thus annoying vibration and noise is transmitted to the outside via the casing 50.

SUMMARY OF THE INVENTION

Accordingly, it is an object of the present invention to provide a hermetic compressor casing having a multi-layer structure in which a damping layer is included to block vibration and noise, and thus reducing vibration and noise produced from a compressor body.

In order to accomplish the above object, in a hermetic compressor casing for enclosing a refrigerant compressing means that draws in low temperature and low pressure gaseous refrigerant from an evaporator, compresses the drawn refrigerant and discharges the compressed refrigerant, the hermetic compressor casing according to the present invention includes an inner shell enclosing the refrigerant compressing means and having a passageway through which the gaseous refrigerant is drawn in and discharged out; a damping layer enclosing the exterior of the inner shell having a predetermined thickness; and an outer shell enclosing the exterior of the damping layer, whereby vibration produced from the refrigerant compressing means is damped through the damping layer.

The inner shell, the damping layer and the outer shell are formed of an integral multi-layer plate. The inner shell and the outer shell are metal, and the damping layer preferably is a viscoelastic polymer.

Further, in order to accomplish the above object, in a hermetic compressor casing as described above according to the present invention includes a lower casing comprising an inner lower shell supporting the refrigerant compressing means and having a passageway through which the gaseous refrigerant is drawn in and discharged out, a lower damping layer enclosing the exterior of the inner lower shell having a predetermined thickness, an outer lower shell enclosing the exterior of the lower damping layer, and an upper casing enclosing an upper portion of the refrigerant compressing means, and assembled to connect with the lower casing, whereby vibration produced from the refrigerant compressing means is damped through the lower damping layer.

The upper casing comprises an inner upper shell made of a metal, an upper damping layer enclosing the inner upper shell having a predetermined thickness, and an outer upper shell enclosing the exterior of the upper damping layer.

The lower casing and the upper casing are formed as a multi-layer plate having a metal layer, a damping layer and a metal layer.

In one embodiment, the upper casing and the lower casing are assembled to connect to each other so that the upper damping layer and the inner lower shell contact each other. In another embodiment, the upper casing and the lower casing are assembled with each other so that the upper damping layer and the lower damping layer contact each other.

With the hermetic compressor casing according to the present invention, as the vibration and noise from the compressor body is damped through the damping layer of the casing, the amount of vibration and noise to the environment outside of the compressor casing can be reduced.

BRIEF DESCRIPTION OF THE DRAWINGS

The above-mentioned objects and the feature of the present invention will be made more apparent by describing the preferred embodiment of the present invention in detail referring to the appended drawings, in which.

DETAILED DESCRIPTION OF PREFERRED EMBODIMENTS

Figure 1:
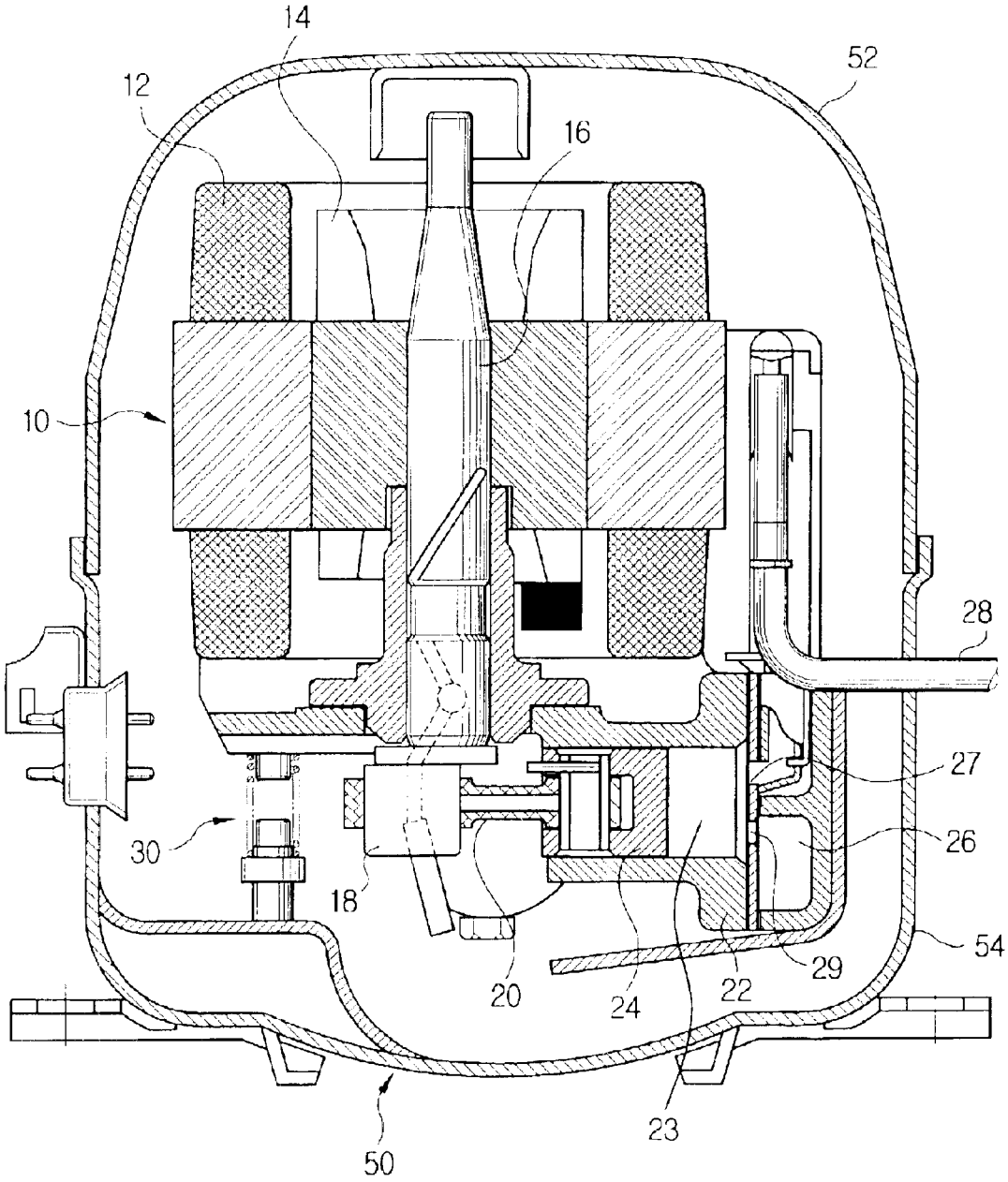
FIG. 1 (PRIOR ART)
FIG. 1 is a cross-sectional view showing a hermetic compressor having a conventional casing.

The present invention will be described in greater detail with reference to the accompanying drawings. Throughout the description, like elements with similar functions will be given the same reference numerals.

Figure 2:
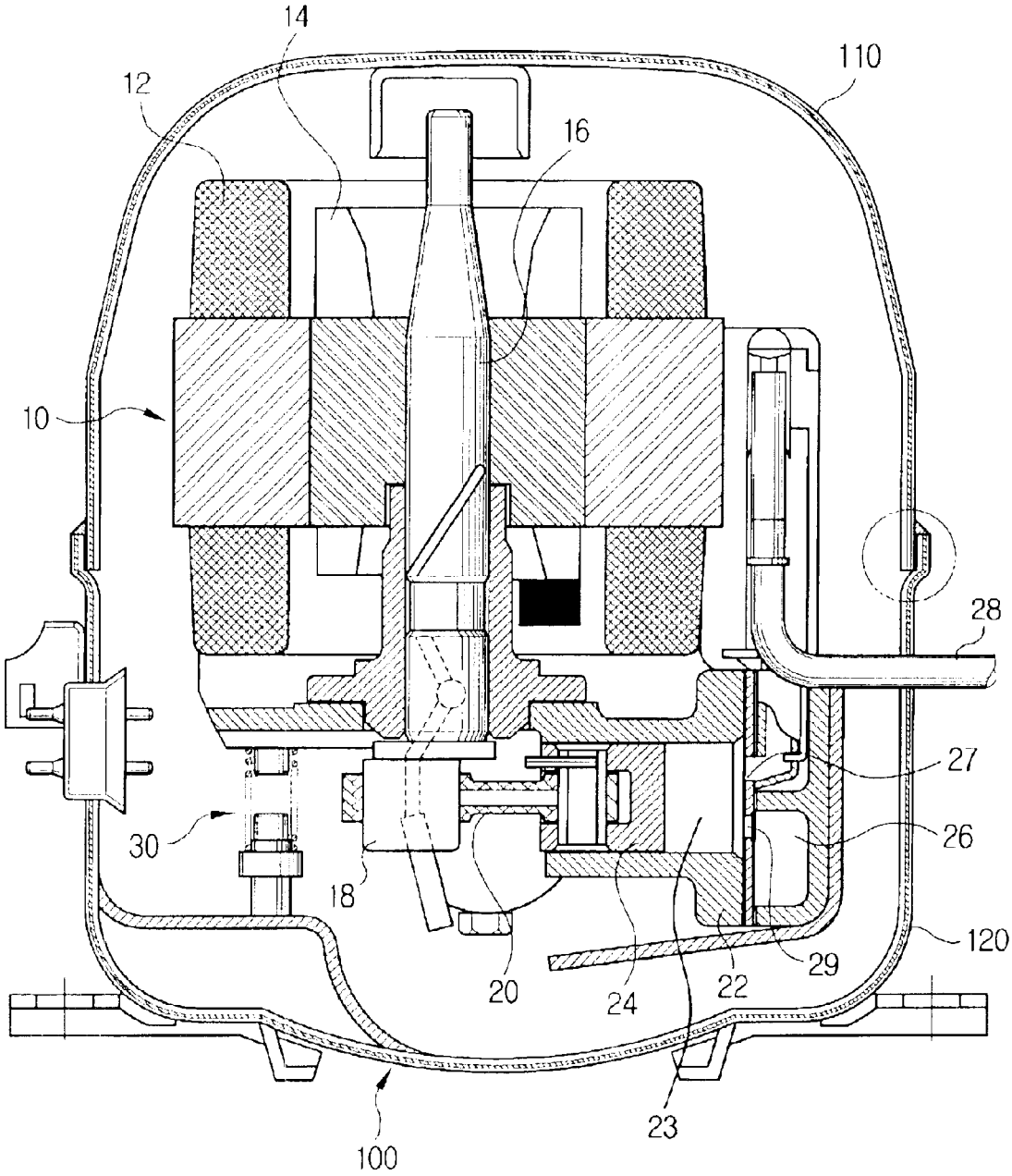
FIG. 2 is a cross-sectional view showing a hermetic compressor having a casing according to the present invention.

Referring to FIG. 2, the hermetic compressor according to the present invention includes a compressor body 10 having a motor, a cylinder and a suction/discharge pipe therein to draw in and compress the refrigerant, a casing 100 partitioning the compressor body 10 from the outside environment, and a supporting member 30 for supporting the compressor body 10 with respect to the casing 100.

The motor includes a stator 12 secured to the supporting member 30 and a rotor 14 rotated inside of the stator 12. A rotary shaft 16 is assembled in the center of the rotor 14, and an eccentric portion 18 is formed at the lower end of the rotary shaft 16, similar to the conventional compressor shown in FIG. 1.

The cylinder includes a cylinder body 22 for defining a refrigerant suction/compression bore 23, and a valve 26 disposed on the upper end of the cylinder body 22 to control suction and discharge of the refrigerant. A piston 24 is assembled within the cylinder body 22 to be reciprocally moved, and the piston 24 is connected to a connecting rod 20 for converting the rotary motion of the eccentric portion 18 of the rotary shaft 16 into reciprocal linear motion.

The suction/discharge pipes 28 connect the valve 26 of the cylinder to the refrigerant cycle, and serve as a passageway through which refrigerant is drawn into the cylinder and discharged out of bore 23.

The supporting member 30 is disposed adjacent the inner lower shell 122 of the lower casing 120, so as to support the stator 12 of the motor and the cylinder body 22 so that the compressor body 10 can be partitioned off from the casing 100. The supporting member 30 preferably comprises a spring so as to absorb the vibration produced during the rotation of the eccentric portion 18 and the reciprocal movement of the piston 24.

The casing 100 encloses the compressor body 10 from the outside, and is provided with lower and upper casings 120 and 110 for more convenient assembly. For more efficient reduction of vibration and noise, the casing 100 can be integrally formed.

Figure 3A:
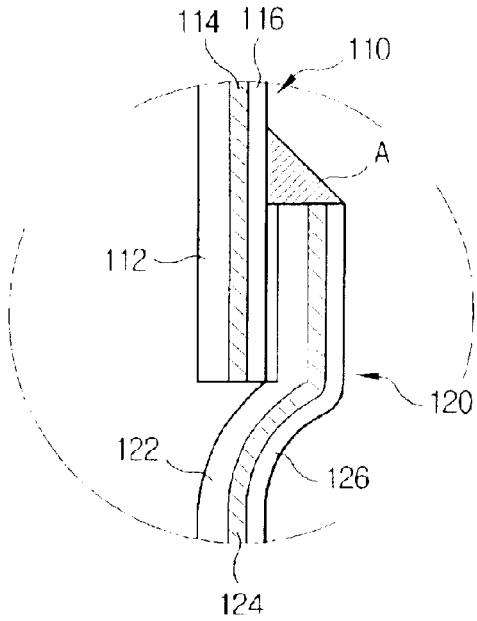
FIGS. 3A, 3B and 3C are detail views showing an assembly portion of upper and lower casings of FIG. 2 according to respective embodiment examples.
Figure 3B:
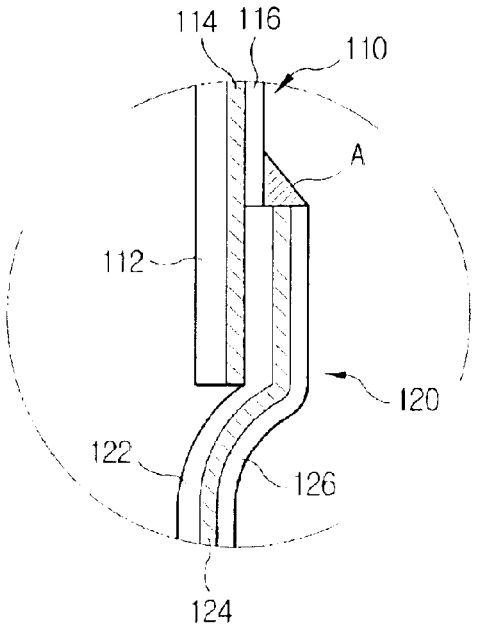
Figure 3C:
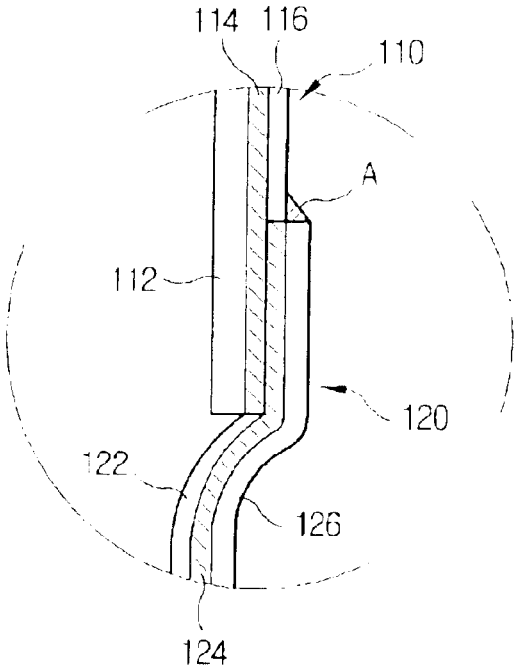

Referring also now to FIGS. 3A, 3B and 3C, the lower casing 120 includes an inner lower shell 122, a lower damping layer 124 and an outer lower shell 126. The supporting member 30 is disposed on the inner lower shell 122, while the compressor body 10 is mounted on the supporting member 30. The inner lower shell 122 has a hole extending therethrough, through which the suction/discharge pipe 28 extends. The inner and outer lower shells 122, 126 can be made of a metal plate by molding, and the damping layer 124 can be made of a material that can block vibration and sound. The lower casing 120 is assembled in the following order, the inner lower shell 122, the damping layer 124 and the outer lower shell 126.

Figure 4:
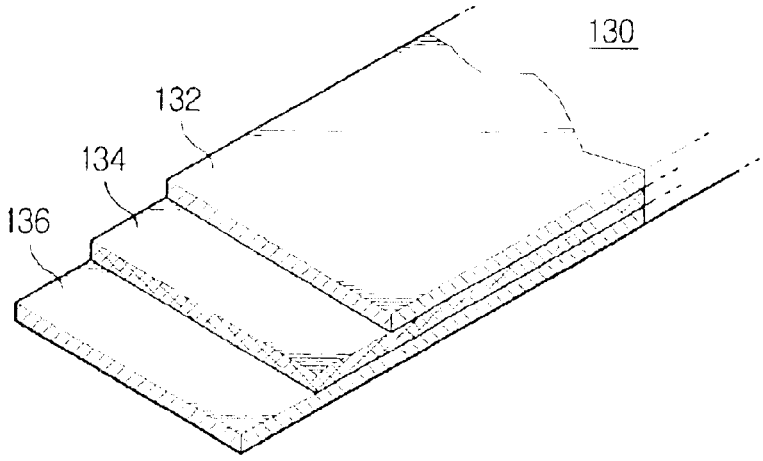
FIG. 4 is a detail view showing a multi-layer structure used for shaping the casing of FIG. 2.

Preferably, the lower casing 120 is made of a multi-layer structure 130 (FIG. 4) (also referred to herein as "double-coalescence metal plate") in which a metal layer 132, a damping layer 134 and a metal layer 136 are integrally formed over one another in turn. It is preferred that the damping layers 124 and/or 134 are formed of a viscoelastic polymer.

The upper casing 110 may be prepared in a conventional way, i.e., by shaping a single metal layer by molding. Preferably, the upper casing 110 is made in the multi-layer structure, as in the lower casing 120. Accordingly, the upper casing 110 is constructed of an inner upper shell 112, an upper damping layer 114 and an outer upper shell 116. The inner upper shell 112 and the outer upper shell 116 are made of metal, while the upper damping layer 114 is made of vibration blocking material. As in the lower casing 120, the upper casing 110 is preferably formed by using the double-coalescence metal plate 130.

Referring to FIGS. 3A through 3C, different embodiments of the connecting structures are shown, the upper casing 110 and the lower casing 120 being connected with each other in the following order: fitting the upper casing 110 into the lower casing 120, and welding the joint area ("A" portion). FIG. 3A shows the adjacent connecting structure of the upper casing 110 and the lower casing 120 in which the outer upper shell 116 of the upper casing is in contact with the inner lower shell 122 of the lower casing 120. FIG. 3B shows the connecting structure between the upper damping layer 114 of the upper casing 110 and the inner lower shell 122 of the lower casing 120. FIG. 3C shows the adjacent connecting structure between the upper damping layer 114 of the upper casing 110 and the lower damping layer 124 of the lower casing 120.

The process of damping the vibration of the compressor body in the hermetic compressor according to the present invention will be described below with reference to the accompanying drawings.

By turning on the electric supply to the compressor, the rotor 14 starts rotating. With the rotation of the rotor 14, the rotary shaft 16, integrally formed with the rotor 14, also rotates. As the rotary shaft 16 rotates, the piston 24 starts reciprocating in the cylinder body 22 by action of the eccentric portion 18 and the connecting rod 20 at one end of the rotary shaft 16. As the piston 24 reciprocates within the cylinder bore 23 in the cylinder body 22, the valve 26 enters into a repeat reciprocal motion, thus permitting the refrigerant to enter for compression and exit to the refrigerant cycle through the suction/discharge pipe 28. Accordingly, as the piston 24 moves to the lower dead end, the suction valve 29 opens to permit the low temperature and lower pressure gaseous refrigerant into the bore 23 of cylinder body 22 through the suction pipe (not shown). As the piston 24 moves toward the upper dead end, the suction valve 29 closes so that the drawn refrigerant is compressed. After the refrigerant compression, the discharge valve 27 opens, thereby permitting the compressed refrigerant to be discharged toward the condenser through the discharge pipe 28. The rotary shaft 16 rotates and the piston 24 keeps moving between the upper and lower dead ends, drawing in and discharging out the refrigerant repeating the cycle.

As described above, during the refrigerant suction, compression and discharge of the compressor body 10, a considerable amount of vibration and noise is produced as the rotor 14 rotates and the rotary motion of the rotor 14 is converted into reciprocal motion of the piston 24 by the action of the eccentric portion 18 and the connecting rod 20. The supporting member 30 absorbs the vibration and noise produced from the compressor body 10, thereby reducing the level of vibration and noise. However, the vibration and noise is incompletely damped, and the vibration and noise is transmitted to the inner lower shell 122. In this case, the vibration and noise is again damped by the damping layer 124 because the vibration and noise is used to deform the viscoelastic polymer that constitutes the damping layer 124. As the vibration and noise is blocked by the presence of the damping layer 124, there is little or no vibration or noise transmitted to the outer lower shell 126. The energy of vibration transmitted from the compressor body 10 to the inner upper shell 112 of the upper casing 110 is also used to deform the upper damping layer 124, and as a result, vibration is reduced.

Figure 5:
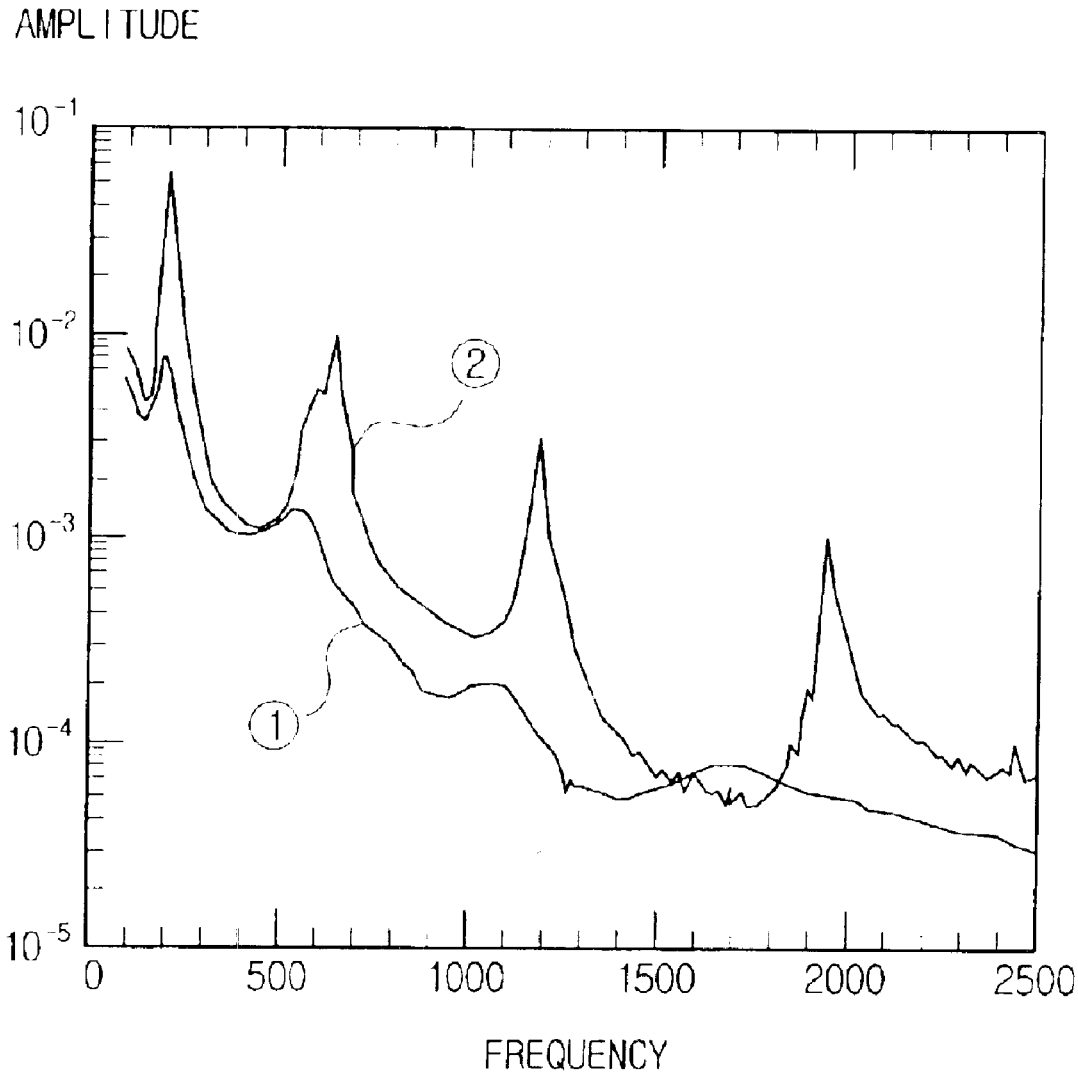
FIG. 5 is a comparison graph showing the amplitude comparison between the hermetic compressor using the casing of FIG. 2 according to the present invention and the hermetic compressor using a conventional casing.
Figure 6:
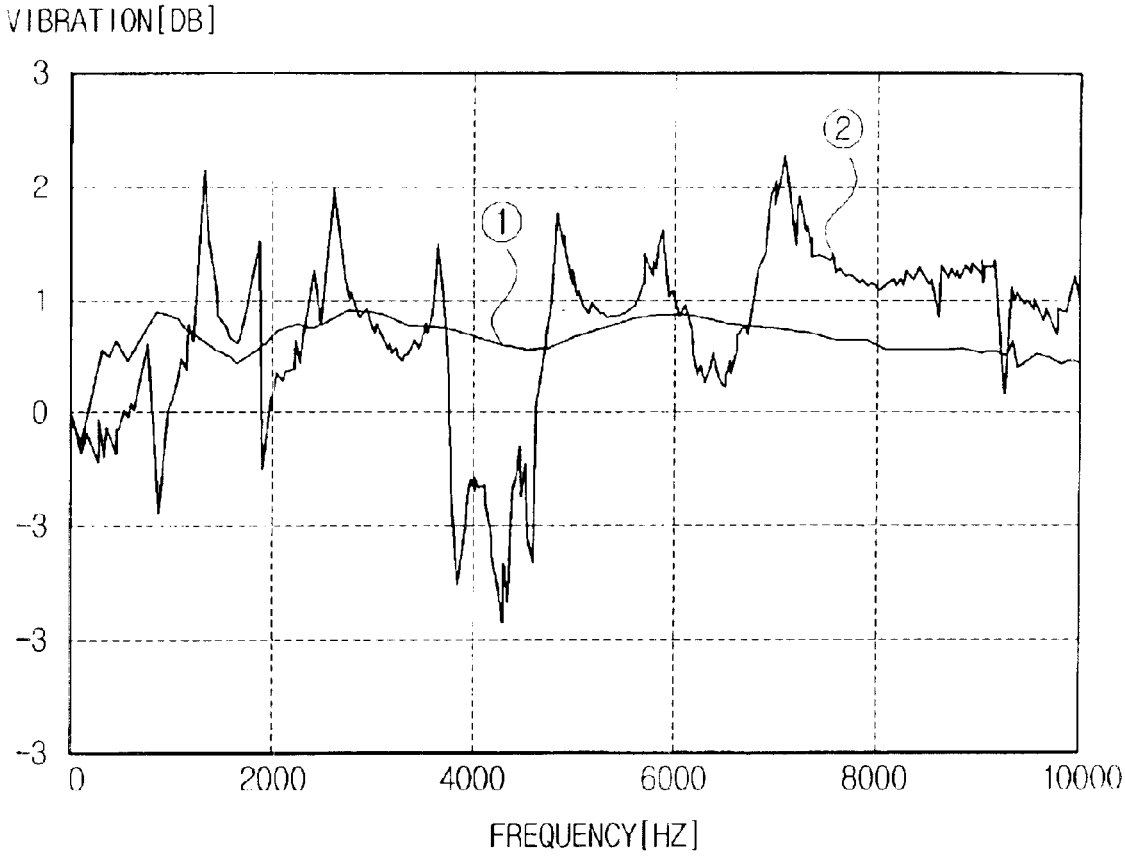
FIG. 6 is a comparison graph showing the level of vibration between the hermetic compressor using the casing of FIG. 2 according to the present invention and the hermetic compressor using a conventional casing.

As described above, with the hermetic compressor casing according to the present invention, the level of vibration and noise from the compressor body 10 to the outside environment is reduced. FIGS. 5 and 6 show the considerable reduction of vibration and noise in the hermetic compressor according to the present invention.

FIGS. 5 and 6 are comparison graphs showing the comparison of amplitude and vibration between the hermetic compressor employing the casing according to the present invention that is made of double-coalescence metal plate having a damping layer of viscoelastic material as against the hermetic compressor employing a conventional casing. The curves 2 in each of FIGS. 5 and 6 represent the amplitude and vibration of the hermetic compressor using a conventional casing, while curves 1 in each of FIGS. 5 and 6 represent the amplitude and vibration of the hermetic compressor using the casing according to the present invention.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A casing for enclosing a refrigerant compressor that draws in gaseous refrigerant from an evaporator, compresses the refrigerant and discharges compressed refrigerant, the casing comprising:

a lower casing comprising an inner lower shell supporting the refrigerant compressor, said lower casing also having a lower damping layer enclosing the exterior of the inner lower shell, said lower damping layer having a predetermined thickness, said lower casing also having an outer lower shell enclosing the exterior of the lower damping layer; and an upper casing enclosing an upper portion of the refrigerant compressor, said upper casing having an inner upper shell, an upper damping layer enclosing the inner upper shell and having a predetermined thickness; and an outer upper shell enclosing the exterior of the upper damping layer, said upper casing assembled with the lower casing, said upper damping layer and the inner lower shell being in contact each other;

whereby vibration produced from the refrigerant compressor is damped by at least one of: the lower damping layer and the upper damping layer.

2. The casing of claim 1, wherein at least one of the lower casing and the upper casing is a multi-layer plate.

3. The casing of claim 1, wherein the damping layer is a viscoelastic polymer.

4. The casing of claim 1, further comprising a refrigerant compressor within the casing.

5. The casing of claim 1, wherein said upper casing and said lower casing are joined to each other to form a substantially hermetic casing.

6. A compressor casing for enclosing a refrigerant compressor that draws in gaseous refrigerant from an evaporator, compresses the refrigerant and discharges compressed refrigerant, the compressor casing comprising:

a lower casing having an inner lower shell supporting the refrigerant compressor and enclosing a lower portion of the refrigerant compressor, said lower casing having a lower damping layer that encloses the exterior of the inner lower shell, said lower damping layer having a predetermined thickness, said lower casing also having an outer lower shell formed to enclose the exterior of the lower damping layer; and an upper casing enclosing an upper portion of the refrigerant compressor, said upper casing having an inner upper shell, said upper casing having an upper damping layer enclosing the inner upper shell and having a predetermined thickness, said upper casing having an outer upper shell enclosing the exterior of the upper damping layer, said upper casing being assembled with the lower casing such that said upper damping layer and the lower damping layer contact each other;

whereby vibration produced from the refrigerant compressor is damped by at least one of the upper damping layer and the lower damping layer.

7. The compressor casing of claim 6, wherein at least one of the inner shell, the damping layer and the outer shell is an integral multi-layer plate.

8. The compressor casing of claim 6, wherein at least one of the damping layers layer is a viscoelastic polymer.

9. A refrigerant compressor comprising:

a compressor;

a lower casing comprising an inner lower shell that supports the compressor and that encloses a lower portion of the compressor, said lower casing being formed to have a lower damping layer that encloses the exterior of the inner lower shell, said lower damping layer being formed to have a predetermined thickness, said lower casing also having an outer lower shell formed to enclose the exterior of the lower damping layer; and an upper casing enclosing an upper portion of the compressor, said upper casing having an inner upper shell, said upper casing having an upper damping layer enclosing the inner upper shell and having a predetermined thickness, said upper casing having an outer upper shell enclosing the exterior of the upper damping layer, said upper casing being assembled with the lower casing such that said upper damping layer and the lower damping layer contact each other;

whereby vibration produced from the compressor within the upper and lower housings is damped by at least one of the upper damping layer and the lower damping layer.

10. The refrigerant compressor of claim 9, wherein the inner shell, the damping layer and the outer shell are a multi-layer plate.

11. The refrigerant compressor of claim 9, wherein the inner shell and the outer shell are metal, and the damping layer is a viscoelastic polymer.

* * * * *